United States Patent [19]

Bell et al.

[11] Patent Number: 4,848,769

[45] Date of Patent: Jul. 18, 1989

[54] GOLF GAME APPARATUS

[75] Inventors: John A. Bell; Harold E. Wilson, both of Winnipeg; Wilford L. McSorley, Calgary, all of Canada

[73] Assignee: Golfore Ltd., Winnipeg, Canada

[21] Appl. No.: 78,811

[22] Filed: Jul. 28, 1987

[51] Int. Cl.[4] ..... A63B 69/36

[52] U.S. Cl. ..... 273/184 B; 206/315.2; 273/185 D; 273/197 A

[58] Field of Search ..... 273/183 R, 184 R, 184 B, 273/185 D, 197 R, 197 A, 200 B; 206/315.2

[56] References Cited

U.S. PATENT DOCUMENTS

| | | | |
|---|---|---|---|
| 2,656,720 | 10/1953 | Sonnett | 273/185 D |
| 2,824,450 | 2/1958 | Para | 273/184 B |
| 3,078,718 | 2/1963 | Hoke | 273/185 D |
| 3,292,436 | 12/1966 | Bahnsen | 273/184 B |
| 3,531,125 | 9/1970 | Anello | 273/200 B |
| 3,535,936 | 10/1970 | Howell | 273/185 D |
| 3,601,408 | 8/1971 | Wright | 273/185 D |
| 3,643,959 | 2/1972 | Cornell et al. | 273/185 R |
| 3,743,296 | 7/1973 | Branz | 273/185 D |
| 3,870,314 | 3/1975 | Bertucci | 273/185 D |
| 3,955,815 | 5/1976 | Deschesnes | 273/184 B |

FOREIGN PATENT DOCUMENTS

| | | | |
|---|---|---|---|
| 184410 | 6/1986 | European Pat. Off. | 273/185 D |
| 2110939 | 6/1983 | United Kingdom | 273/183 R |

*Primary Examiner*—Carlton R. Croyle
*Assistant Examiner*—Robert N. Blackmon
*Attorney, Agent, or Firm*—Adrian D. Battison; Stanley G. Ade

[57] ABSTRACT

A golf game device comprises a base unit side to carry a simulated ball and provide a horizontal pad section simulating a driving surface. A stant unit is sized to receive the feet of the golfer in this stance when the base unit is positioned to one side of the stand unit for driving of the simulated ball. The stand unit is formed as a case into which the base unit can be inserted. A separate arm carries a display head which can be attached to one side of the base unit by a receptacle on the base unit or can be attached to the opposed side of the base unit so the base unit can be used either by left handed or right handed golfer with a display head facing inwardly toward the golfer. The display head includes only a simple digital distance display together with LED hook and slice display and a speaker to generate a string of pulses simulating ball flight.

11 Claims, 4 Drawing Sheets

GOLF GAME APPARATUS

BACKGROUND OF THE INVENTION

This invention relates to a golf game apparatus and particularly one which comprises a practice device for golfers.

Many golfers want to practice their driver or fairway woods but are required to either hit balls into an adjacent netting or use a practice range at a golf club or a commercial driving range facility. This requires two objectionable features: placing a ball on the tee after each hit and physically picking up the balls at the net or on the range.

Various devices have been proposed for providing a simulated ball which can be stroked by a golf club so that the ball effectively remains captive within the system while generating information to the user as to the effectiveness of the stroke made on the ball member.

Such devices are proposed to eliminate the tedious chores stated above and to allow the golfer to concentrate more upon making the correct contact with the ball.

Many of the simulated golf game devices are highly complex in nature and include displays which show simulated golf games including movement of the ball towards a green and further electronic simulations coupling on the base member arranged. These devices are therefore highly complex and highly expensive and thus have a limited market often as coin operated devices so the capital equipment is used on an extensive basis to justify the high initial cost.

It is one object of the present invention to provide an improved device which is of a relatively simple nature both in structural and electronics terms so that it can be manufactured and sold at a relatively low price and allow purchase of units for individual use by golfers or as practice units on golf courses where the capital equipment cost can be justified as a service to the members rather than as a cost which must be recovered by charging fees for practice shots.

According to a first aspect of the invention, there is provided therefore a golf game apparatus comprising a base member having a lower surface for resting upon the ground, an upper surface spaced from the lower surface and upstanding side surfaces interconnecting the upper and lower surfaces, a simulated ball member, means mounting the ball member on the base member such that it projects upwardly from the upper surface add such that it is allowed captive movement relative thereto when struck by a golf club in a direction along the upper surface, a display head member having a head and a support arm and means for mounting the display head member at a position to one side of the base member, wherein said base member is substantially rectangular and is of a size sufficient substantially only to receive said ball member and insufficient to receive feet of a user when positioned in a golfing stance relative to the ball member, said arm being inclined upwardly and outwardly away from said base member so as to present said head at a position spaced away from said base member and wherein said ball member is mounted upon one end of a flexible shaft and wherein is provided pivot means mounting an opposed end of said flexible shaft on said base member for pivotal movement thereon about a substantially horizontal axis such that said shaft can move from a substantially vertical position presenting said ball member upwardly for hitting by a club to an impacted position in which the shaft is substantially horizontal and wherein there is provided means for sensing a velocity of movement of said shaft from said vertical position to said impacted position and means for sensing a twisting movement of said shaft.

According to a second aspect of the invention there is provided a golf game apparatus comprising a base member having a lower surface for resting upon the ground, an upper surface spaced from the lower surface and upstanding side surfaces interconnecting the upper and lower surfaces, a simulated ball member, means mounting the ball member on the base member such that it projects upwardly from the upper surface and such that it is allowed captive movement relative thereto when struck by a golf club in a direction along the upper surface, a display head member having a head and a support arm and means for mounting the display head member at a position to one side of the base member said display head member including digital display means for displaying a distance of movement of a ball, means for calculating electronically said distance in dependence upon movement of said ball member caused by impact from the stroke of a club, and means for indicating a degree of lateral movement of said ball caused by spin applied to the ball from the impact of the stroke of a club.

The device according to the invention can include on the display head a digital display which displays the distance in yards or meters that a real golf ball would have travelled by a similar hit. The speed at which the golf club moves the captive or simulated ball is sampled electronically and after a brief computational time the appropriate distance is displayed at the display head by three lighted digital readout numbers.

For added enjoyment and just prior to the digital display, a beeping sound or series of sound pulses signals the relative distance hit with the longer the distance of the hit, the longer the period of the total of the pulses. Also, as part of the display, five light emitting diodes can be installed in the display head with one central diode and two diodes to either side of the central diode. When the ball has been hit relatively straight as determined by measuring the twist applied to the simulated ball, the center light is illuminated. If the ball is hooked or sliced to one side or the other one of the side diodes will be illuminated depending upon the degree of hook or slice determined by the amount of spin on the ball.

The electronic circuitry has been designed on a printed circuit board so that it completely fits in the display head. The only wires outside the head are those connecting to the sensors in the simulated ball device and wires for the power supply. All electronics are supplied by a low voltage 12 VDC power source. When battery operated, the batteries are located in a concealed location in the base member. A transformer for 110 VAC can be mounted in the same position.

In essence therefore, there are three basic response signals which show up each time the golfer hits the ball. These are the beeping sound for simulating the movement of the ball, one of the led light units for transverse accuracy, hook or slice, and finally the three digit display for yards or meters. After this sequence is complete, the electronic system automatically recycles to a start setting until the ball is hit and the procedure is repeated.

To accommodate the left-handed golfer, it is only necessary to remove the display head and support as a unit from the coupling on one side of the base member and insert it into a similar coupling on the other side of the base member. To complete the transformation the separate golfer stand can be moved to the other side of the ball unit and positioned as required for the golfer's stance.

The device can be completely portable in that by removing the display head and support arm from its coupling on the base member, the display head and support arm can be stored underneath the base member and then the base member inserted into the stand for receiving the golfers' feet so the total unit folds up into a suitcase sized portable package which can thus be simply transported.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

Figure 1:
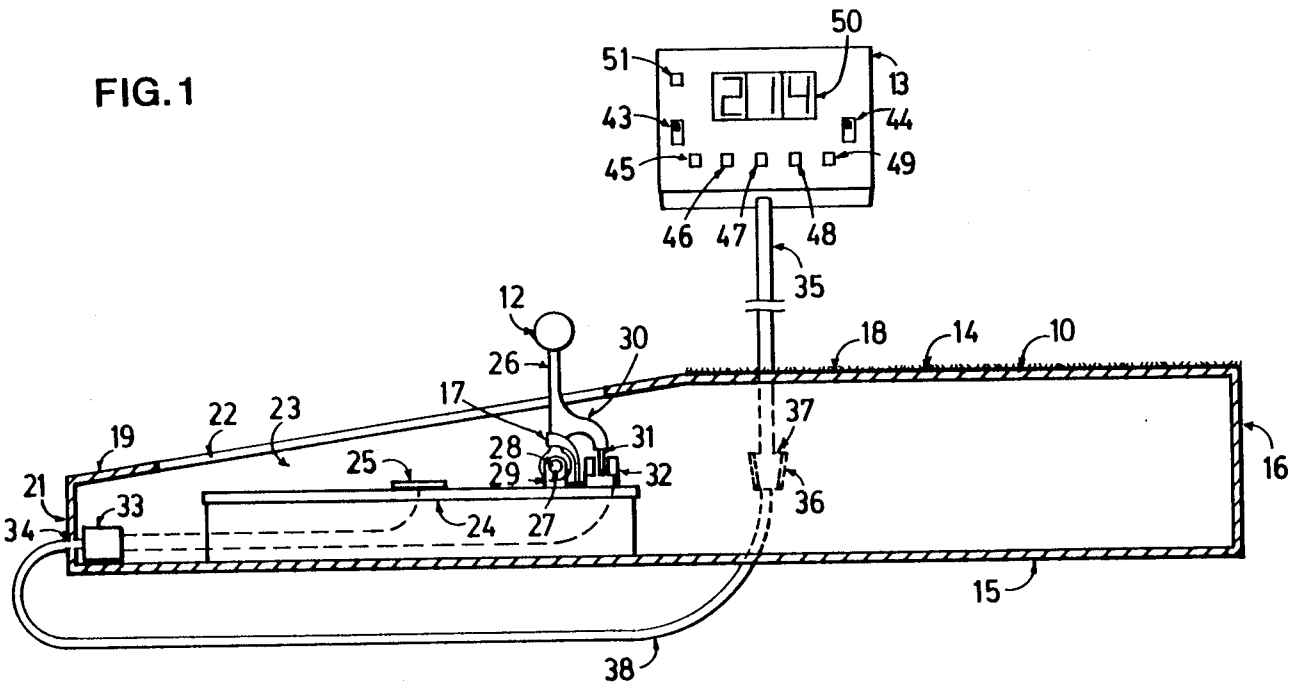
FIG. 1 is a longitudinal cross-sectional view of a base stand carry unit and display head.
Figure 2:
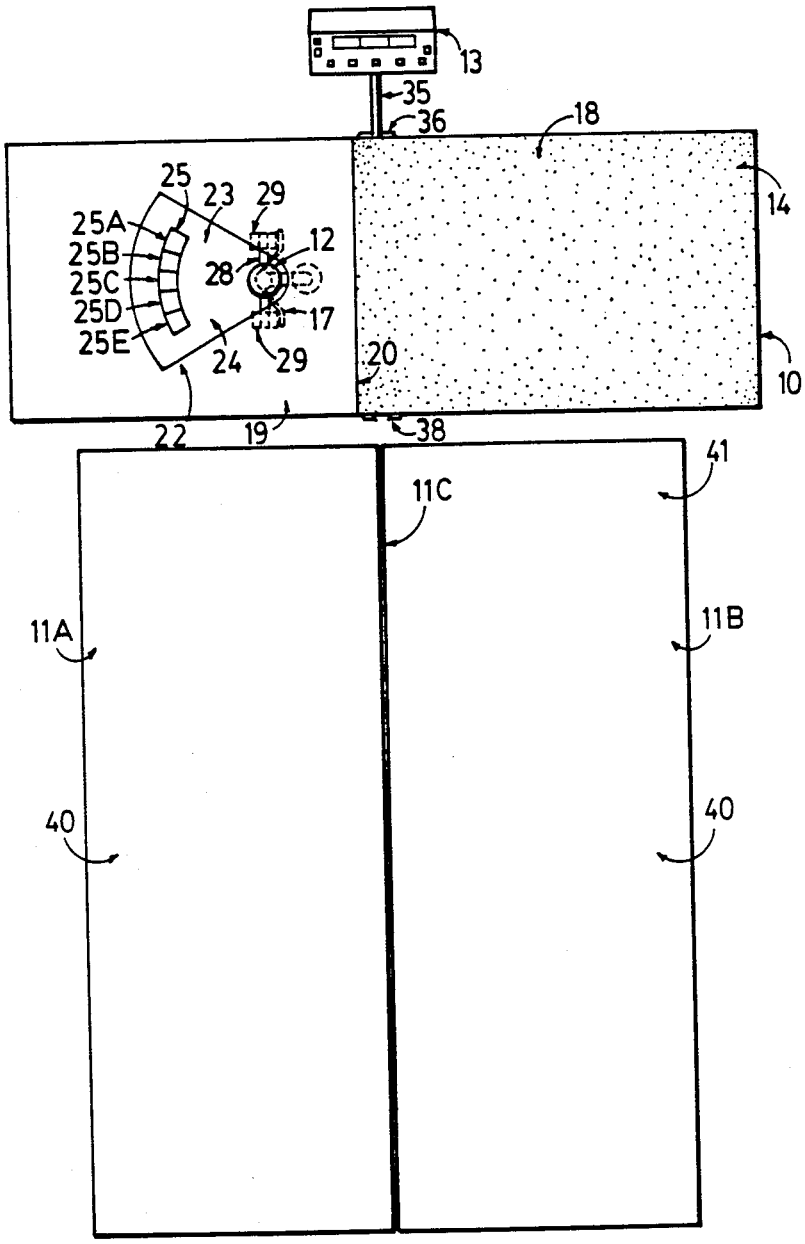
FIG. 2 is a top plan view of the base stand of FIG. 1 in association with a foot stand for a golfer adjacent to the base unit.

Turning firstly to FIGS. 1 and 2, the structure of the unit comprises a base unit 10, a stand unit 11, a simulated ball member 12 and a display head 13.

The base unit 10 is generally rectangular with an upper surface 14, a lower surface 15 which is flat and arranged to rest directly on the ground and upstanding sides 16. The base unit is generally hollow and formed by the rigid surfaces and sides so to be rigidly self-supporting when resting on the ground and of sufficient strength so that it can receive the weight of a user.

The upper surface 14 includes a flat horizontal portion 18 and a slightly inclined front portion 19 which inclines downwardly from a transverse line 20 at a forward edge of the flat portion 18 to a front side wall indicated at 21. A triangular opening 22 is provided in the upper incline surface 19 to expose the simulated ball 12 and its mounting arrangement generally indicated at 23. The simulated ball 12 is therefore presented in actuating position thereof at the upper edge of the inclined surface 19 immediately behind the forward most edge 20 of the horizontal portion 18. The horizontal portion 18 can be covered with a suitable material for example to simulate grass so the golfer effectively sees a horizontal driving surface provided by the surface 18 with the ball mounted for hitting immediately behind the forward most edge of the surface 18.

The ball unit 23 comprises a base plate 24 on which is mounted a sensor pad 25 which is constituted by a plurality of separate pads 25A, 25B, 25C, 25D and 25E. The simulated ball 12 is mounted upon flexible shaft 26 which in the actuation position of the ball 12 is substantially vertical. The shaft 26 is formed of a flexible elastomeric material which is sufficiently strong to hold the ball captive to the unit but also allows some twisting or bending to occur, dependent upon the direction of forces applied to the ball by the club.

The shaft 26 has a transverse base 27 at the lower end through which a rod 28 is passed and mounted in suitable supports 29 on either side of the shaft 26. This allows the shaft 26 to pivot about a horizontal axis to move from the erected condition shown in FIG. 1 to a lowered or impacted condition shown in FIG. 3 in which the ball lies upon the sensor pad 25. A rubber band is wrapped around the supports 29 and the front position of the shaft 26 biasses the shaft 26 to the erected condition.

The shaft 26 carries integrally therewith a trailing piece 30 which supports a magnet 31 which extends downwardly therefrom into a coil 32 with a coil mounted rigidly on the base plate 24. The magnet in the erected actuating position of the ball shown in FIG. 1 is presented into the center of the coil so that movement of the ball in the direction of impact from a club toward the pad 25 acts to pull the magnet out of the coil and generate a voltage pulse which is dependent in magnitude upon the velocity of movement of the magnet and thus in the velocity of movement of the ball.

The sensor pads 25A through 25E are arranged with a central one of the pads 25C directly in line with forward movement of the ball 12. Pads 25A and 25B lie on side of the central pad 25C and the remaining pads 25D and 25E lie on the opposed side. Hook or slice applied to the ball by a stroke from the club will therefore act to twist the shaft 26 and this causes the ball to move toward one of the pads on either side of the central pad 25C dependent upon the degree of hook or slice. Each of the pads 25A through 25E therefore acts as a switch which senses an impact from the ball and thus indicates the degree of twist caused by hook or slice from an improper stroke of the ball by the club.

The sensor pad 25 and also the coil 32 are connected to a terminal block 33 by way of suitable electrical interconnections with the terminal block providing a connector 34 at the exterior of the base unit 10. A display head 13 is mounted upon an arm 35 which is formed by a simple tubular member of very much smaller dimension than the size of the head 13. The tubular member extends downwardly and inwardly from the head to a coupling 36 on one side face of the base unit. The coupling 36 can simply be provided by a tapered receptacle of the well known type into which a spade coupling 37 on the lower end of the tubular arm 35 can be inserted by vertical downward movement so that when inserted the arm 35 is held in the required position to support the head 13 to one side of and upwardly from the base unit. Thus the front base of the head is presented at a position for simple viewing by the golfer but can readily be removed by lifting of the head away from the side so that the spade coupling 37 is removed from the receptacle 36. A connector wire 38 extends through the tubular arm 35 and then freely from the lower end of the tubular arm 35 to the connector 34 so the head member can be totally removed from the base unit.

As shown best in FIG. 2, the receptacle 36 is provided on one side face of the base unit so as to present the display head approximately at the mid position of the base unit and upstanding therefrom. On an opposed face of the base unit is provided a further receptacle 38 directly similar to but exactly opposite to the receptacle 36 so that when removed, the display unit and the support arm can be moved around to the other side of the base unit to present the display head facing inwardly but on the opposite side for use by a left handed golfer.

Figure 3:
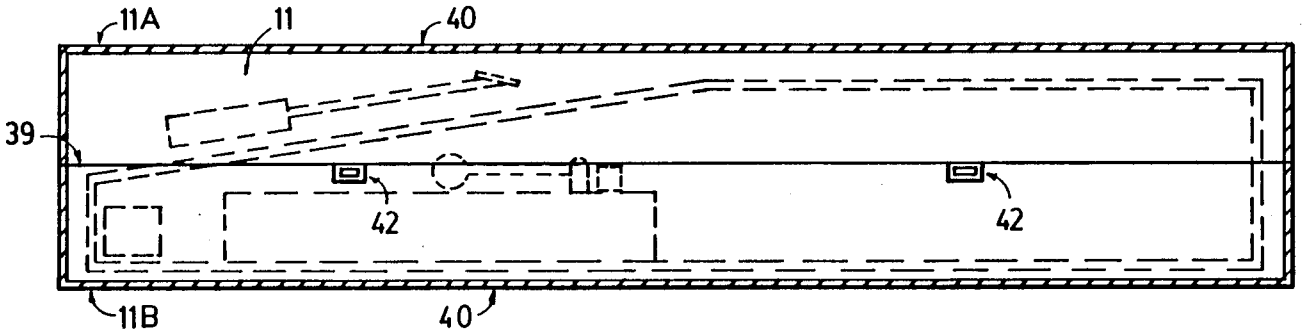
FIG. 3 is a front elevational view of the foot stand of FIG. 2 showing in phantom the stored base unit and display head.

The stand unit 11 shown in FIGS. 2 and 3 forms a rectangular case having two hinged case parts 11A and 11B jointed at a hinge line 11C. Each of the case parts has a lower surface 39, an upper surface 40 and a plurality of upstanding sides. In the position shown in FIG. 2, the upper surface 40 of each of the parts carries simulated grass material or the like similar to the upper surface 18 of the base unit so that a golfer can stand upon the two parts of the stand unit when it is suitably positioned relative to the base unit to accommodate his stance and the length of the club for proper presentation to the simulated ball 12. The stand unit 11 is thus manufactured in a form of a case having the hinge line 11C and a latch mechanism indicated at 42 so that the upper surface can be pivoted to expose a hollow interior into one part of which the base unit can be inserted as shown best in FIG. 3. In addition, with the display head 13 removed from its position on the side of the base unit, the display head can be inserted into the other part of the case in the hollow interior as shown in FIG. 3 so that the whole of the unit is inserted into the case 11 for simple transportation, while the case itself forms the stand for the golfer's feet.

Turning now to the details of the display head, the display head includes the electronics mounted on a suitable circuit board and carried within the interior of the display head on the front face of the display head an on/off switch indicated at 43, a meter/yard switch indicated at 44, 5 LEDs 45, 46, 47, 48 and 49 and a digital display system indicated at 50 and constituted by three digits. In addition there is provided a speaker 51.

Figure 4:
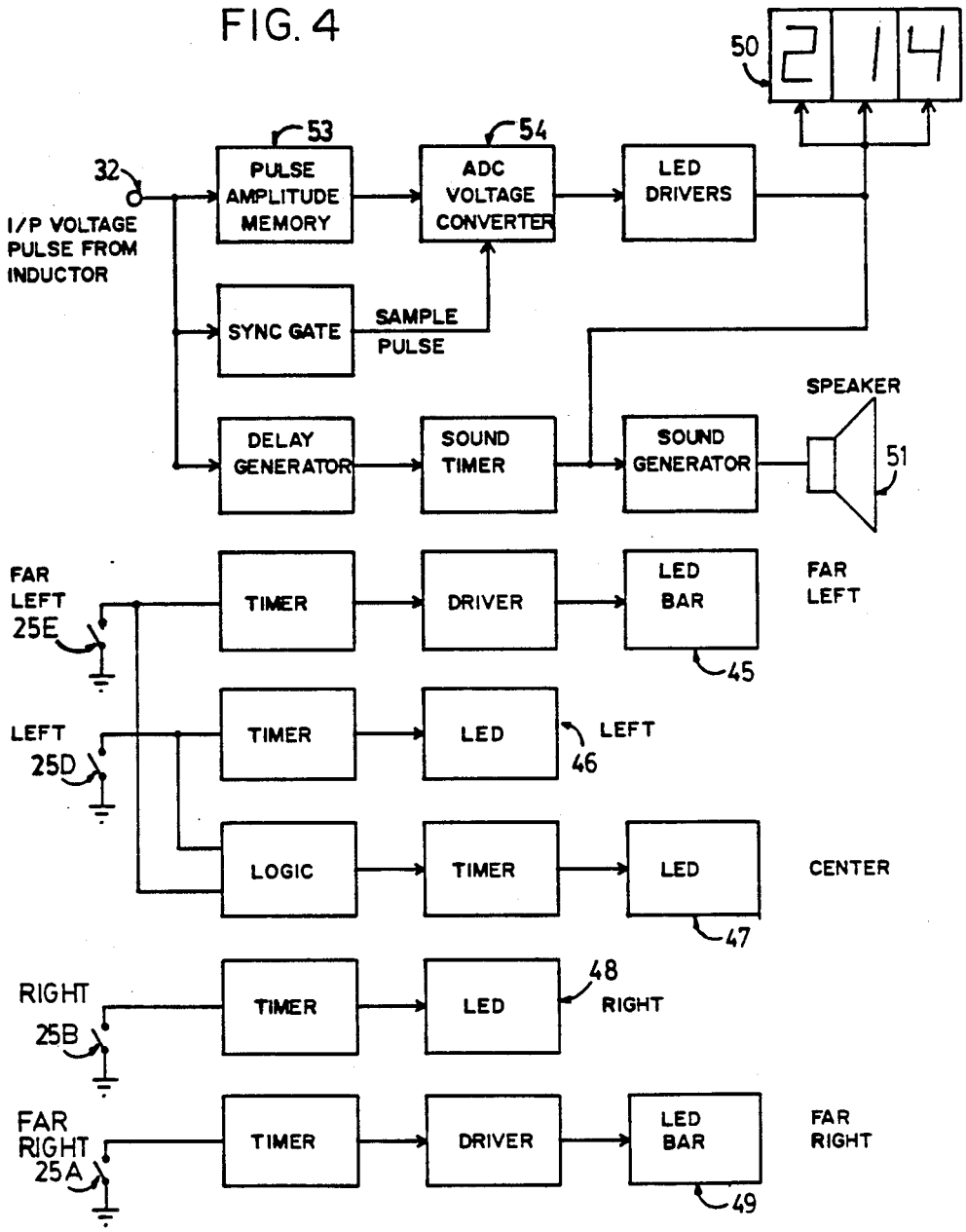
FIG. 4 is a block schematic diagram of the electronic circuitry.

Turning now to the circuit diagram shown in FIG. 4, the inputs from the coil 32 and the pad 25 are shown together with the outputs on the front face of the display head. The electronic circuitry is constituted simply by various timers and drivers which actuate the LEDs as required. The pulse from the coil 32 is entered into a memory 53 and is generated into a digital pulse by an analogue/digital converter indicated at 54. The speaker 51 is used to generate a series of pulses with a number of pulses being created in dependence upon the size of the voltage pulse so as to simulate a length of travel of the ball independence upon the movement of the simulated ball. After a delay during which the speaker is actuated, the digital display is actuated to display the calculated distance of movement of the ball. At the same time as the digital display is actuated, the respective one of the LEDs 45 through 49 is also actuated to indicate to the golfer the accuracy of his stroke.

The electronic circuitry thus uses the latest technology to present the data to the user of the device. It is designed to operate on a 9V to 12V DC battery source to provide portability or it can use a plug in power pack to provide the voltage from main supply.

The pulse generated by the coil drives an integrating or voltage "hold" circuit with the hold voltage being sampled by the A/D converter IC which converts the amplitude of the voltage to binary figure. The binary or digital data is converted to operate 3 LEDs which indicate the range the ball travels. In addition the pulse triggers the logic circuitry to provide a "beeping" sound roughly equivalent to the speed of the ball after a time determined by the amplitude of the voltage pulse (dependent upon the time taken for the ball to stop the beeping stops and the range to where the ball is driven and displayed on the digital display. After a period of approximately five seconds the circuitry resets itself and is ready for another "drive".

In an alternative arrangement (not shown), the display head can be mounted on a separate stand so as to be free standing relative to the base. In this way it can be positioned at any suitable location for observation by the golfer or any onlookers.

Since various modifications can be made in my invention as hereinabove described, and many apparently widely different embodiments of same made within the spirit and scope of the claims without departing from such spirit and scope, it i intended that all matter contained in the accompanying specification shall be interpreted as illustrative only and not in a limiting sense.

We claim:

1. A golf game apparatus comprising a base member having a lower surface for resting upon the ground, an upper surface spaced from the lower surface and upstanding side surfaces interconnecting the upper and lower surfaces, a simulated ball member, means mounted in the ball member on the base member such that it projects upwardly from the upper surface and such that it is allowed captive movement relative thereto when struck by a golf club in a direction along the upper surface, a display head member having a head and a support arm and means for mounting the display head member at a position to one side of the base member, wherein said upper surface is substantially rectangular and is of a size sufficient substantially only to receive said ball member and insufficient to receive feet of a user when positioned in a golfing stance relative to the ball member and includes a top horizontal surface and a surface inclined downwardly therefrom toward a front edge thereof, said ball member being mounted in an opening in said inclined surface at a position forwardly of a front edge of said top surface and movable in a direction away from said top surface, said opening being substantially triangular extending from said ball member outwardly to either side of a direction of intended movement of the ball member, said mounting means being arranged such that it can present said head at a position spaced away from said base member, said ball member being mounted upon one end of a flexible shaft including pivot means mounting an opposed end of said flexible shaft on said base member for pivotal movement thereon about a substantially horizontal axis such that said shaft can move from a substantially vertical position presenting said ball member upwardly for hitting by a club to an impacted position in which the shaft is substantially horizontal and wherein there is provided means for sensing a velocity of movement of said shaft from said vertical position to said impacted position comprising a magnet mounted on said shaft and a coil for generating an electromagnetic pulse in dependence upon the movement of the magnet away from the coil and means for sensing a twisting movement of said shaft comprising a plurality of pressure sensing device spaced transversely along a line of possible impact of said ball member with a pad at said impact position of said shaft such that twisting of the shaft causes the ball member to impact different ones of said pressure sensing devices in dependence upon an amount of twist applied to the ball member by the stroke from the club, said display head member including display means consisting solely of digital display means for displaying a distance of movement of a ball and light indicator means for displaying a degree and direction of transverse movement of a ball, means for generating a series of pulse sounds dependent upon said distance, and delay means for delaying display of said distance until a time subsequent to completion of said series of pulsed sounds.

2. A golf game apparatus comprising a base member having a lower surface for resting upon the ground, an upper surface spaced from the lower surface and upstanding side surfaces interconnecting the upper and lower surfaces a simulated ball member, means mounting the ball member on the base member such that it projects upwardly from the upper surface and such that it is allowed captive movement relative thereto when struck by a golf club in a direction along the upper surface, a display head member having a head and a support arm, means for mounting the display head member at a position to one side of the base member, wherein said upper surface is substantially rectangular and is of a size sufficient substantially only to receive said ball member and insufficient to receive feet of a user when positioned in a golfing stance relative to the ball member, said mounting means being arranged such that it can present said head at a position spaced away from said base member, said ball member being mounted upon one end of a flexible shaft including pivot means mounting an opposed end of said flexible shaft on said base member for pivotal movement thereon about a substantially horizontal axis such that said shaft can move from a substantially vertical position presenting said ball member upwardly for hitting by a club to an impacted and means for sensing a twisting movement of said shaft, and a closeable cases for receiving said base member and said display head member therein, including two halves each defining a substantially flat rectangular base surface having side walls extending at right angles to edges thereof such as the two halves can be closed together to enclose the base member and the display head member and such that the two halves can be opened to expose an outer side of said flat base surface thereof on which a golfer can stand for presentation to said ball member on said base member with the height of the side walls of each of the halves being substantially equal to the height of the base member.

3. The invention according to claim 2 wherein the upper surface includes a flat top portion and a portion inclined downwardly therefrom at a shallow angle thereto, the ball member being arranged to project upwardly from the inclined portion adjacent the flat top portion and being movable in a direction away from the flat top portion.

4. The invention according to claim 2 wherein said velocity sensing means comprises a magnet mounted on said shaft and a coil for generating an electromagnetic pulse in dependence upon the movement of the magnet away from the coil.

5. The invention according to claim 2 wherein said twist sensing means comprises a plurality of pressure sensing devices spaced transversely along a line of possible impact of said all member with a pad at said impact position of said shaft such that twisting of the shaft causing the ball member to impact different ones of said pressure sensing devices in dependent upon an amount of twist applied to the ball member by the stroke from the club.

6. The invention according to claim 2 wherein the display head member includes digital display means for displaying a distance of movement of a ball and means for calculating electronically said distance in dependence upon movement of said ball member caused by impact from the stroke of a club.

7. The invention according to claim 2 wherein the display head member includes means for indicating a degree of lateral movement of said ball caused by pin applied to the ball from the impact of the stroke of a club.

8. The invention according to claim 2 wherein said display head member includes display means consisting solely of digital display means for displaying a distance of movement of a ball and light indicator means for displaying a degree in direction of transverse movement of a ball.

9. The invention according to claim 8 wherein said display head member includes means for generating a series of pulse sounds dependent upon said distance 10. The invention according to claim 8 including the delay means for delaying display of said distance until a time subsequent to completion of said series of pulsed sounds 11. The invention according to claim 2 wherein the base member includes a top horizontal surface and a surface inclined downwardly therefrom toward a front edge thereof, said ball member being mounted in an opening in said inclined surface at a position forwardly of a front edge of said top surface and movable in a direction away from said top surface, said opening being substantially triangular extending from said ball member outwardly to either side of a direction of intended movement of the ball member.

* * * * *